US005727647A

United States Patent [19]

Brantley, Jr.

[11] Patent Number: 5,727,647

[45] Date of Patent: Mar. 17, 1998

[54] APPRATUS AND METHOD FOR PROVIDING INCREASED DEFLECTION RESISTANCE TO A PLANK

[76] Inventor: Martin T. Brantley, Jr., 1802 Umstead Rd., Durham, N.C. 27712

[21] Appl. No.: 656,983

[22] Filed: Jun. 6, 1996

[51] Int. Cl.[6] ..... E04G 5/08

[52] U.S. Cl. ..... 182/82; 182/222; 182/217

[58] Field of Search ..... 182/82, 222, 119, 182/223, 217, 218

[56] References Cited

U.S. PATENT DOCUMENTS

| | | | |
|---|---|---|---|
| 1,142,955 | 6/1915 | Gaw . | |
| 2,198,960 | 3/1940 | Deck | 304/32 |
| 2,569,450 | 8/1951 | Bouton | 24/251 |
| 4,984,656 | 1/1991 | Doolittle | 182/222 |

FOREIGN PATENT DOCUMENTS

| | | | |
|---|---|---|---|
| 3245126 | 6/1984 | Germany | 182/222 |

*Primary Examiner*—Alvin C. Chin-Shue
*Assistant Examiner*—Long Dinh Phan

[57] ABSTRACT

A brace is provided for providing increased deflection resistance to a primary plank wherein the brace includes a frame member having an upper portion and a lower portion. The upper portion is adapted for supported and maintaining a primary plank in a fixed position, and the lower portion is adapted for supporting and maintaining a secondary plank in a fixed position such that the secondary plank and the primary plank extend in identical directions with the secondary plank being spaced-apart from and perpendicular to the primary plank whereby increased deflection resistance is provided to the primary plank.

18 Claims, 3 Drawing Sheets

APPRATUS AND METHOD FOR PROVIDING INCREASED DEFLECTION RESISTANCE TO A PLANK

TECHNICAL FIELD

The present invention relates generally to apparatuses and methods for increasing deflection resistance of a plank. More particularly, the present invention relates to a novel apparatus and method for providing increased deflection resistance to a plank, wherein the apparatus and method are particularly applicable for providing increased deflection resistance to a scaffold plank utilizing one or more pump jacks in association therewith.

RELATED ART

The use of scaffolding in the construction trade to enable workers to work from elevated positions is well known. Such scaffolding typically utilizes one or more planks which can be of varying lengths and widths and can be wooden or aluminum in construction. The planks are usually supported by some type of frame which can be of various designs. The use of one or more pump jacks in association with a scaffold is common in order to raise and lower one or more planks as desired.

Planks are typically identified by the dimensions of their widths and thicknesses. As an example, a "2×10" plank would have a thickness of approximately two (2) inches and a width of approximately ten (10) inches. The length of a plank can vary since it can easily be cut to a desired length. As the dimensions of different scaffolds can vary, the sizes of planking utilized in the scaffolds can therefore vary as well.

Scaffold systems or structures utilizing one or more pump jacks in association therewith often use one or more "2×10" planks that are approximately sixteen (16) feet in length although planks of other dimensions can also be used. Such planks are suspended between two or more vertically positioned pump jacks which can be used to raise and lower portions or entire lengths of the planks to a desired height. The planks can be wooden or aluminum in construction, however, an aluminum plank will typically be much more expensive than a wooden plank of the same or similar size, and accordingly, more likely to be stolen.

Scaffolds utilizing pump jacks are typically used for securement of exterior siding and overhangs to a building. The planks are preferably in a substantially horizontal position from side edge to side edge in order to allow one or more workers to walk on top of the planks. Using the pump jacks, opposing ends of the planks can be raised to different levels to elevate the planks while placing them in a desired angled position suitable for working on an angled area such as an angled eave of a building.

Deflection of the planks due to weight from workers and/or equipment placed upon the planks can therefore understandably be very dangerous for workers standing and/or walking on top of the planks. The areas of the planks between plank supports are understandably at increased risk for deflection, and the danger of deflection of the planks, especially wooden ones, is obviously heightened as the length of the planks increases. As a result, scaffolds using pump jacks can use planks of a sufficiently short length such that any deflection is minimal or non-existent, or they can utilize longer planks and some type of support or supports for minimizing or preventing deflection between opposing ends of the planks. Sometimes planks are even stacked upon one another in an effort to minimize deflection.

U.S. Pat. No. 4,984,656 to Doolittle discloses a brace for positioning a second scaffolding plank vertically beneath a first horizontal plank so as to decrease deflection of the scaffolding plank. The metal brace extends around both the scaffolding plank and the vertical second plank therebeneath so as to secure them against one another in a rigid manner. This type of brace for providing deflection resistance to a scaffold plank is however undesirable and impractical for use with a scaffold plank utilizing one or more pump jacks in association therewith since the pump jacks will not be able to extend across the entire width of the bottom side of the horizontal scaffold plank so as to provide the support to the plank needed during movement of the plank by the pump jacks.

U.S. Pat. No. 2,569,450 to Bouton discloses a clamp for securing together scaffolding boards or planks in order to provide a platform. Notably, the clamp is used to secure together planks in a side-by-side relationship in erecting scaffolding.

Despite the prior art apparatuses and methods, much room for improvement exists in the art of apparatuses and methods for increasing deflection resistance of planks, particularly for an apparatus and method for increasing deflection resistance of planks in a scaffold utilizing one or more pump jacks in association therewith.

DISCLOSURE OF THE INVENTION

The present invention provides a brace for providing increased deflection resistance to one or more primary planks. The brace comprises a frame member having an upper portion and a lower portion. The upper portion defines primary plank support means for supporting and maintaining one or more primary planks in a substantially fixed position. The lower portion of the frame member defines secondary plank support means for supporting and maintaining one or more secondary planks in a substantially fixed position such that the secondary planks and the primary planks extend in substantially identical directions with the secondary planks being spaced-apart from the primary planks whereby the secondary planks provide increased deflection resistance to the primary planks. In the preferred embodiment, the secondary planks are maintained in a substantially perpendicular position to the longitudinal axes of the primary planks. A plurality of such braces can be utilized to enable secondary planks of a suitable length to provide increased deflection resistance to primary planks of varying lengths.

It is therefore an object of the present invention to provide a novel apparatus and method for providing increased deflection resistance to a plank, particularly a scaffold plank.

It is another object of the present invention to provide an apparatus and method for providing increased deflection resistance to a plank while allowing the plank to be particularly suitable for use in association with one or more pump jacks for elevating and lowering the plank or portions thereof.

It is a further object of the present invention to provide an apparatus and method for providing increased deflection resistance to a plank which can be simply and easily utilized.

It is still a further object of the present invention to provide an apparatus and method for providing increased deflection resistance to a plank wherein the apparatus and method are more effective than prior art apparatuses and methods for providing deflection resistance to a plank.

Some of the objects of the invention having been stated hereinabove, other objects will become evident as the description proceeds, when taken in connection with the accompanying drawings as best described hereinbelow.

BEST MODE FOR CARRYING OUT THE INVENTION

In accordance with the present invention, a brace is provided which can be utilized to provide increased deflection resistance to one or more planks such as a plank for use in a scaffold utilizing pump jacks in association therewith. Each embodiment of a brace according to this invention can quickly and easily be attached to a primary plank to support and maintain the primary plank in a substantially fixed position. Under normal operating conditions, the position of the primary plank will be substantially horizontal side to side in order to allow workers to have a level surface upon which to walk and place items. Each embodiment of a brace according to this invention additionally can be quickly and easily attached to a secondary plank to support and maintain the secondary plank in a substantially fixed position spaced-apart from the primary plank. In the preferred embodiment, and as discussed further hereinbelow, the secondary plank extends in the same direction as the primary plank and is positioned in a sideways vertical manner such that the secondary plank is perpendicular to the longitudinal axis of the primary plank. As an advantageous feature of this invention, each embodiment of the brace maintains the primary plank and secondary plank in a spaced-apart relationship with a gap or space therebetween of a size sufficient for placement and movement of the support section of a pump jack. A plurality of braces according to this invention can be used together to provide increased deflection resistance to one or more primary planks.

Figure 1:
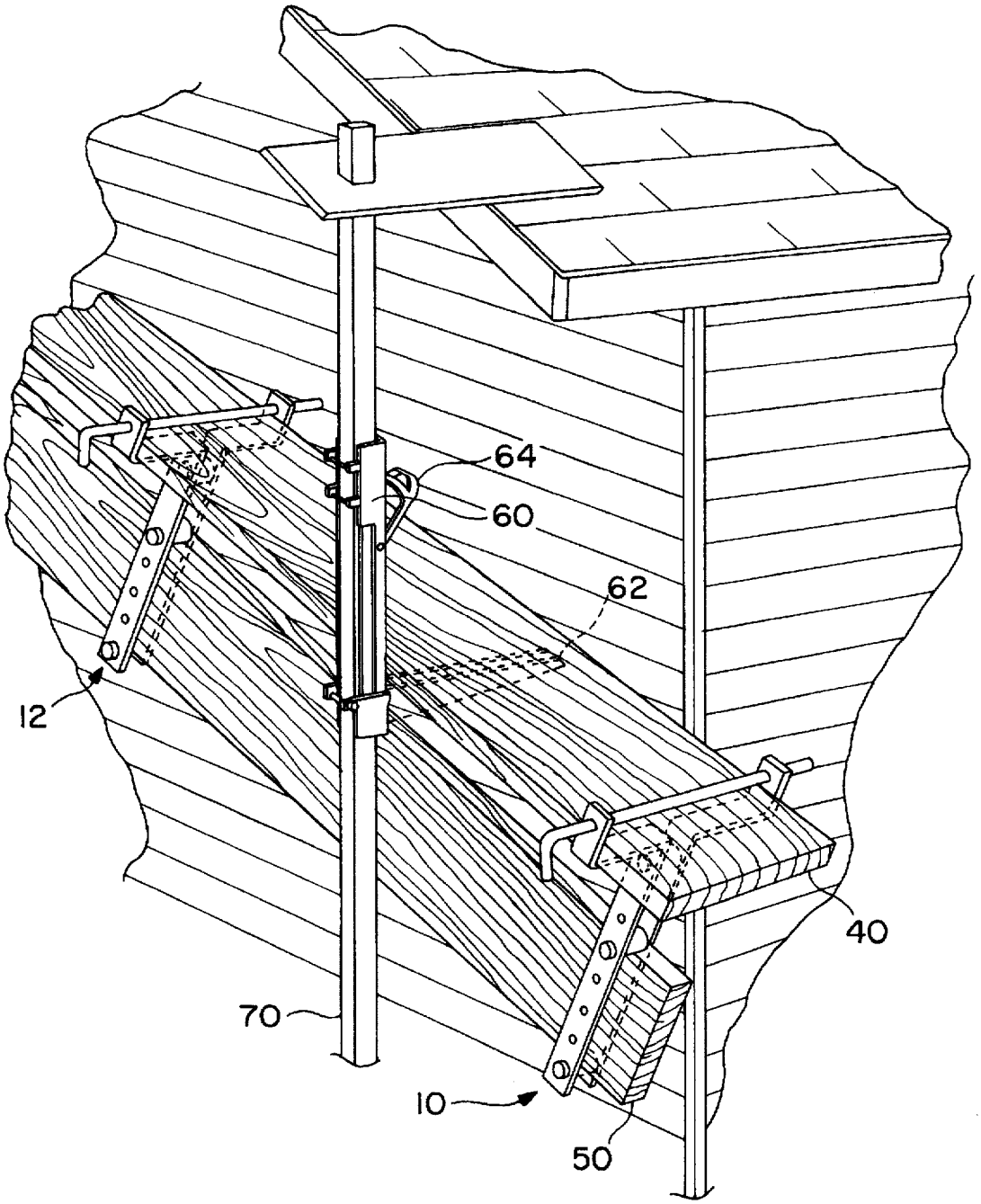
FIG. 1 of the drawings is a perspective view of one embodiment of braces of this invention used in a scaffold as the braces are secured to a secondary plank and a primary plank to provide increased deflection resistance to the primary plank.

Referring to FIG. 1 of the drawings, a section of a scaffold is illustrated and comprises a pair of one embodiment of braces according to this invention, generally designated 10 and 12, which are identical and operatively connect primary plank 40 and secondary plank 50. Braces 10 and 12 are metal in the preferred embodiment, but it is envisioned that any suitable material of construction could be used for a brace according to this invention. Although one primary plank and secondary plank are shown, a plurality of primary planks and/or secondary planks can be supported and maintained in position by braces be 10 and 12.

A conventional pump jack generally designated 60 is attached to a vertical beam 70 and includes a support section 62 which contacts the bottom side of primary plank 40 to support primary plank 40 in a desired position. Only one vertical beam 70 with pump jack 60 thereon is illustrated in the sectional view of FIG. 1. Typically, however, at least two or more vertical beams having pump jacks attached thereto are utilized to support a plank such as primary plank 40, and such vertical beams are usually spaced-apart such that at least one vertical beam is proximate each end of a supported scaffold plank. The pump jacks, such as pump jack 60, commonly include a foot pedal, such as foot pedal 64, which can be used to pump a pump jack so as to cause it to vertically elevate on a vertical beam to which it is attached. As illustrated by primary plank 40 in FIG. 1, it is common for pump jacks attached to different vertical beams to be positioned at different vertical elevations so as to cause ends of a scaffold plank to be at different vertical elevations where the plank is supported and maintained at an angled position, from end to end, rather than a horizontal position. Understandably, the pump jacks of different vertical beams can be positioned so as to support and maintain a scaffold plank in a substantially horizontal end to end position as well. Although FIG. 1 illustrates braces 10 and 12 used in a scaffold system utilizing a pump jack, it can be appreciated that one or more braces in accordance with this invention can be used with other types of support structures as well.

Figure 2:
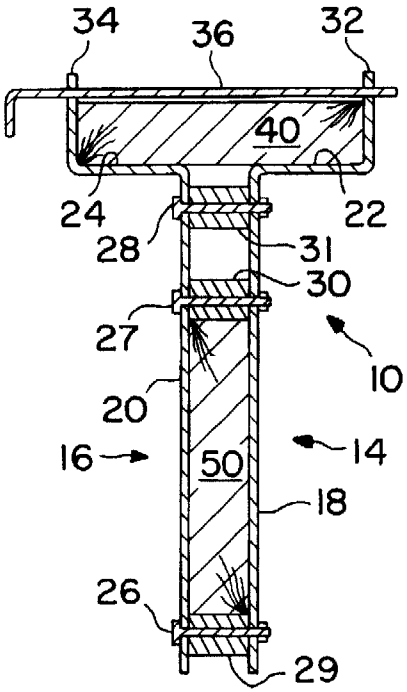
FIG. 2 of the drawings is an end view of the planks shown in FIG. 1.

FIG. 2 of the drawings is an isolated end view of primary plank 40 and secondary plank 50 from FIG. 1 showing brace 10 connected thereto and further illustrates the preferred positional relationship between a primary plank and a secondary plank in accordance with this invention. As shown, secondary plank 50 is spaced-apart from and substantially perpendicular to the longitudinal axis and center of primary plank 40. While it is envisioned that the spacing between primary plank 40 and secondary plank SO can vary, such spacing is preferably of a distance sufficiently suitable for placement of the support section of one or more pump jacks therebetween in order to supportingly raise and lower primary plank 40. It can also be understood that other items such as pipes and/or wires could be positioned in the space therebetween instead of or in addition to the support section of a pump jack.

Although it is envisioned that braces of various structures can be utilized to maintain primary plank 40 and secondary plank 50 in a positional relationship as described herein, braces 10 and 12 illustrate one embodiment of a brace according to this invention. As braces 10 and 12 are identical, a more detailed description of brace 10 only is set forth hereinbelow.

Figure 4:
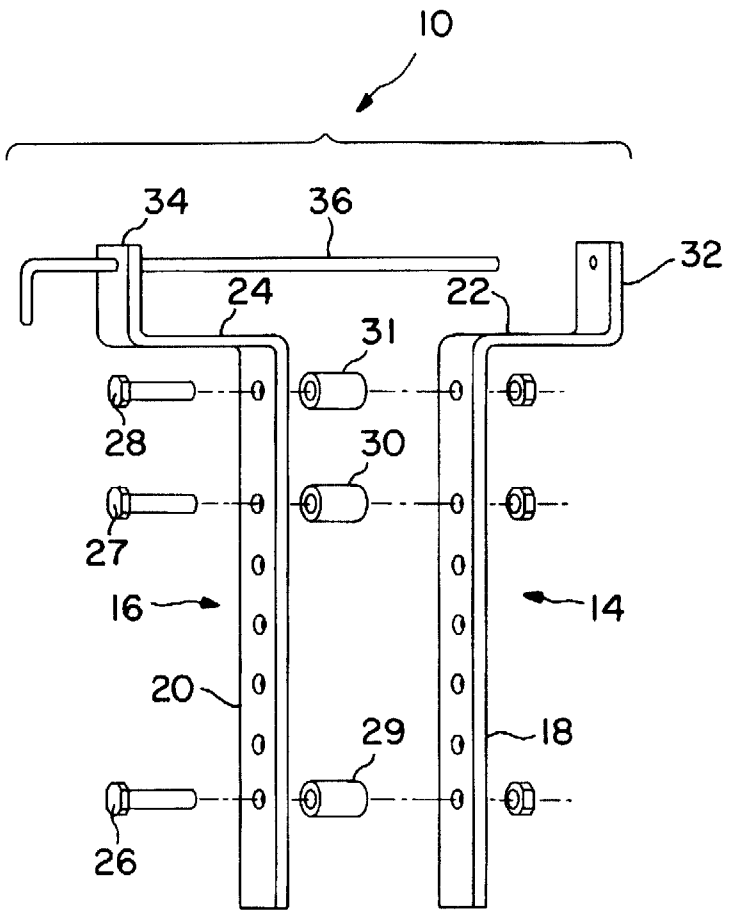
FIG. 4 of the drawings is an exploded isolated perspective view of one of the braces shown in FIG. 1.
Figure 3:
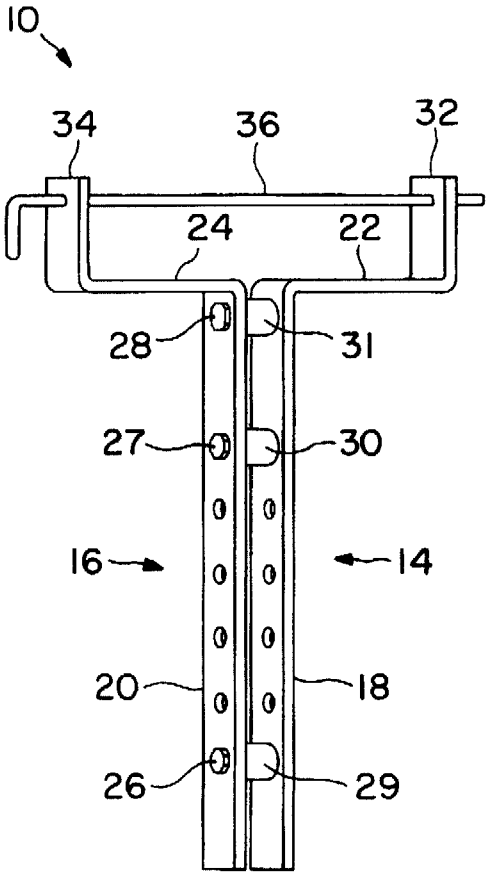
FIG. 3 of the drawings is an isolated perspective view of one of the braces shown in FIG. 1 in assembled form.

Referring to FIGS. 2–4, brace 10 comprises a frame member made up of a pair of disconnectable frame elements generally designated 14 and 16 which each comprise an elongate leg 18 and 20, respectively, and a support surface 22 and 24, respectively, extending substantially perpendicularly from the elongate legs. It is contemplated according to this invention, however, that elongate legs 18 and 20 can be angled at the upper ends thereof and that support surfaces 22 and 24 can extend from such angled portions at any angle suitable for maintaining a primary plank in a position in accordance with this invention. Support surfaces 22 and 24 are preferably in an at least substantially horizontal position when brace 10 is attached to primary plank 40 and utilized in a scaffold so that primary plank 40 is substantially horizontal from side to side as shown in FIGS. 1 and 2. Frame elements 14 and 16 are connectable to one another, preferably in a spaced-apart manner (as shown in FIGS. 2 and 3) by bolts 26, 27 and 28 which pass through apertures defined in elongate legs 18 and 20 of frame elements 14 and 16, respectively. Bolts 26, 27 and 28 pass through spacers 29, 30 and 31, respectively, which are positioned between elongate legs 18 and 20 of frame elements 14 and 16 and can be of various sizes and shapes for desired suitability with planks of various sizes and shapes. Conventional nuts of a size sufficient for matingly receiving bolts 26, 27 and 28 can be used to secure the bolts in position. Although brace 10 is shown with three bolts and spacers, bolt 28 and spacer 31 are not necessarily required for proper functioning of brace 10. While the bolts can be tightened as desired, they are preferably still loose enough to allow the spacers through which they pass to act as rollers as well.

Brace 10 therefore has a lower portion generally comprising elongate legs 18 and 20 of frame elements 14 and 16, respectively, and an upper portion generally comprising support surfaces 22 and 24 of frame elements 14 and 16, respectively. The lower portion of brace 10 can support and maintain a secondary plank, such as secondary plank 50 illustrated in FIG. 2, in a fixed position between elongate legs 18 and 20 of frame elements 14 and 16, respectively, wherein the side edges defining the thickness of the secondary plank can be positioned between and against at least a pair of the spacers, such as spacers 29 and 30, used to separate elongate legs 18 and 20 and act as rollers for the secondary plank, and the surfaces of the secondary plank defining the width thereof can be placed against and between elongate legs 18 and 20. The elongate legs and spacers of the lower portion of brace 10 therefore can define a slotted open passage as shown in FIG. 3 and 4 for placement of one or more secondary planks therethrough.

The upper portion of brace 10 can support and maintain a primary plank in a fixed position against support surfaces 22 and 24. In addition to support surfaces 22 and 24, the upper portion of brace 10 preferably comprises a pair of flanges 32 and 34 extending perpendicularly from support surfaces 22 and 24, respectively, in an opposite direction from elongate legs 18 and 20, respectively. The upper portion of brace 10 also preferably comprises a pin or rod 36 which can be a rebar and which is removably receivable within apertures defined through flanges 32 and 34 wherein rod 36 is spaced-apart from and substantially parallel to support surfaces 22 and 24. In this manner, a slotted open passage perpendicular to the passage for holding a secondary plank can be defined by support surfaces 22 and 24, flanges 32 and 34, and rod 36 as shown in FIGS. 3 and 4 for placement of a primary plank therethrough wherein the primary plank can be supported and maintained therein.

Attaching brace 10 to a secondary plank and a primary plank can therefore be easily accomplished by loosening or even removing the bolts and nuts and tightening them when the brace is properly in place on the secondary plank and primary plank. The spacers can act as rollers as discussed above to facilitate attachment as well as removal of brace 10 to the secondary plank. The order in which brace 10 is attached to a secondary and primary plank is not critical.

Figure 5:
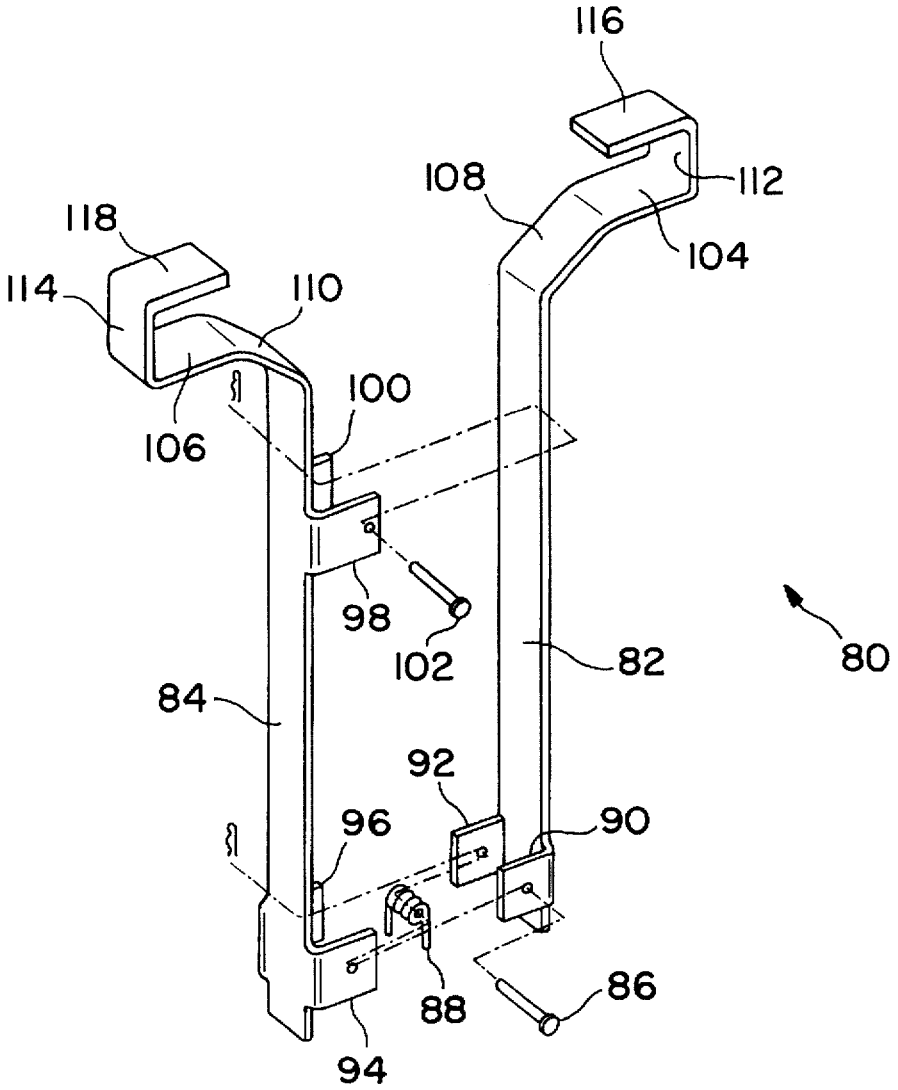
FIG. 5 of the drawings is a perspective view of another embodiment of a brace according to this invention.

Referring to FIG. 5 of the drawings, another embodiment of a brace according to the present invention is shown and generally designated brace 80. As with braces 10 and 12, brace 80 is preferably metal in construction and can be utilized to provide increased deflection resistance to one or more primary planks by the attachment of one or more secondary planks to brace 80 whereby the secondary planks are preferably supported and maintained in a fixed position spaced-apart from and perpendicular to the longitudinal axes of the primary planks.

Brace 80 comprises elongate legs 82 and 84 which are preferably pivotally connected by a pin 86 at the bottom ends thereof with a biasing member such as spring 88 positioned therebetween which preferably biases the portions of elongate legs 82 and 84 above spring 88 towards one another. Connecting flanges such as connecting flanges 90 and 92 of elongate leg 82 and connecting flanges 94 and 96 of elongate leg 84 can be used to pivotally connect elongate legs 82 and 84 as well as provide a surface which can be used to support and maintain a secondary plank between elongate legs 82 and 84. Brace 80 further comprises a pair of connecting flanges 98 and 100 extending from elongate leg 84 in a spaced-apart manner from and substantially parallel to connecting flanges 90, 92, 94 and 96. Elongate leg 82 can be positioned between connecting flanges 98 and 100 near elongate leg 84 and maintained in such position by placement of a quick-release pin 102 which can be placed through apertures defined through connecting flanges 98 and 100 and can extend adjacent elongate leg 82 to maintain elongate leg 82 proximate elongate leg 84. Connecting flanges 98 and 100 also provide a surface which can be used to support and maintain a secondary plank in its fixed position. It can therefore be seen that the lower portion of brace 80 generally comprises elongate legs 82 and 84, and that a slotted open passage can be defined by elongate legs 82 and 84 and the connecting flanges described herein for placement of a secondary plank therethrough whereby the secondary plank can be supported and maintained in a fixed position therein.

Brace 80 also has an upper portion generally comprising support surfaces 104 and 106 of elongate legs 82 and 84, respectively, wherein support surfaces 104 and 106 extend from angled surfaces 108 and 110, respectively, which in turn extend from elongate legs 82 and 84, respectively. To enable brace 80 to support and maintain a primary plank in a fixed position, side flanges 112 and 114 extend perpendicularly from support surfaces 102 and 104, respectively, in a direction opposite from that of elongate legs 82 and 84, and end flanges 116 and 118 extend perpendicularly from side flanges 112 and 114, respectively, toward one another and substantially parallel to support surfaces 102 and 104, respectively. It is envisioned in accordance with this invention that the sizes of support surfaces 104 and 106, side flanges 112 and 114, and end flanges 16 and 18 can vary as desired in order to accommodate one or more primary plank of various sizes.

Brace 80 therefore illustrates another embodiment of a brace according to this invention which can be utilized to maintain a secondary plank in a spaced-apart manner from a primary plank whereby the secondary plank is substantially perpendicular to the longitudinal axis of the primary plank. Brace 80 affords simplicity and ease of use as it can be connected to and disconnected from a secondary plank and a primary plank by utilization of quick-release pin 102 in conjunction with pivotal movement of elongate legs 82 and 84.

It is therefore seen that the present invention provides a novel apparatus and method for providing increased deflection resistance to a primary plank, particularly a primary plank used in scaffolding utilizing pump jacks in association therewith. It is further seen that the present invention provides such an apparatus and method which is effective, simple and easy to use.

It will be understood that various details of the invention may be changed without departing from the scope of the invention. Furthermore, the foregoing description is for the purpose of illustration only, and not for the purpose of limitation, as the invention is defined by the following, appended claims.

What is claimed is:

1. A brace for providing intermittently spaced deflection resistance to one or more primary planks, said braze comprising:

(A) a frame member having an upper portion and a lower portion;

(B) primary plank support means defined by said upper portion of said frame member for supporting and maintaining one or more primary planks in a substantially fixed position separate and apart from secondary planks; and (C) secondary plank support means defined by said lower portion of said frame member for supporting and maintaining one or more secondary planks in a substantially fixed position such that the secondary planks and the primary planks extend in substantially identical directions with the secondary planks being spaced-apart from and substantially perpendicular to the primary planks whereby intermittently spaced deflection resistance is provided to the primary planks wherein said primary plank support means comprises one or more substantially horizontal surface with upward flanges extending from said horizontal support surfaces for supporting and separating said primary plank from secondary plank.

2. The brace of claim 1 wherein said secondary plank support means is adapted tier intermittently supporting and maintaining a secondary plank substantially perpendicular to the longitudinal axis of a primary plank supported and maintained by said primary plank support means.

3. The brace of claim 1 wherein primary plank support means defines a slotted passage and said secondary plank support means defines a slotted passage substantially perpendicular to said slotted passage defined by said primary plank support means.

4. The brace of claim 1 wherein said primary plank support means further comprises a removable rod spaced-apart from said horizontal support surfaces for maintaining a primary plank in position within said primary plank support means.

5. The brace of claim 1 wherein said primary plank support means comprises a substantially horizontal open passage defined by said upper portion for supportingly receiving one or more primary planks in a substantially horizontal position therethrough separate and apart from secondary planks.

6. The brace of claim 5 wherein said upper portion of said frame member comprises a pair of substantially horizontal support surfaces defining a portion of said horizontal open passage wherein said horizontal support surfaces together can support one or more primary planks thereon.

7. The brace of claim 1 wherein said secondary plank support means comprises a substantially vertical open passage defined by said lower portion for receiving one or more secondary planks in a substantially vertical position therethrough separate and apart from primary plank.

8. The brace of claim 7 wherein said tower portion of said frame member comprises a pair of substantially vertical and substantially parallel opposing legs connectable so as to define said substantially vertical open passage and provide separation of primary and secondary planks.

9. The brace of claim 1 wherein said frame member comprises a plurality of disconnectable frame elements, each frame element comprising an elongate leg and a horizontal support surface extending substantially perpendicularly from said leg and wherein said primary plank support means comprises said horizontal support surfaces and said secondary plank support means comprises said elongate legs.

10. The brace of claim 9 wherein said elongate legs of said frame elements are connected at a lower end thereof opposite said horizontal support surfaces.

11. The brace of claim 9 wherein said frame elements are connected by a quick-release pin between said secondary plank support means and said horizontal support surfaces.

12. The brace of claim 1 further comprising one of more primary planks supported planks supported and maintained in position separate and apart from secondary planks by said primary plank support means.

13. The brace of claim 12 further comprising one or more secondary planks supported and maintained in position separate and apart from primary planks by said secondary plank support means.

14. A brace providing intermittently spaced deflection resistance to one or more primary planks, said brace comprising:

(A) a frame member having an upper portion and a lower portion;

(B) said upper portion of said frame member defining means supporting one or more primary planks in a substantially fixed position separate and apart from secondary planks; and (C) said lower portion of said frame member defining means supporting one or more secondary planks in a substantially fixed position such that said primary planks and said secondary planks extend in substantially identical directions with said secondary planks being spaced-apart from and substantially perpendicular to said primary planks, whereby intermittently spaced deflection resistance is provided to the primary planks wherein said primary plank support means comprises one or more substantially horizontal surface with upward flanges extending from said horizontal support surfaces for supporting and separating said primary plank from secondary plank.

15. The brace of claim 14 wherein said secondary planks are substantially perpendicular to the longitudinal axes of said primary planks.

16. A plurality or braces according to claim 14 wherein said braces are spaced-apart from one another along the lengths of said primary planks and said secondary pranks providing intermittent support to both primary and secondary planks.

17. A plurality of braces according to claim 18 wherein a distance separating said primary planks and said secondary plunks is substantially maintained between the lengths thereof.

18. A method for providing intermittently spaced deflection resistance to a primary plank, said method comprising the steps of:

(A) providing a plurality of braces; each brace comprising: a frame member having an upper portion and a lower portion;

primary plank support means defined by said upper portion of said frame member for supporting and maintaining one or more primary planks in a substantially fixed position separate and apart from secondary planks; and secondary plank support means defined by said lower portion of said frame member for supporting and maintaining one or more secondary planks in a substantially fixed position such that the secondary planks and the primary planks extend in substantially identical directions and the secondary planks are spaced-apart from and substantially perpendicular to the primary planks whereby intermittently spaced deflection resistance is provided to the primary planks wherein said primary plank support means comprises one or more substantially horizontal surface with upward flanges extending from said horizontal support surfaces for supporting and separating said primary plank from secondary plank;

(B) fixedly attaching said braces to a primary plank by positioning said braces on said primary plank such that said primary plank is supported and maintained in a substantially fixed position by said primary plank support means separate and apart from secondary plank; and (C) attaching at least one secondary plank to said braces by positioning said braces on said secondary plank such that said secondary plank is supported and maintained in a substantially fixed position by said secondary plank support means whereby said primary plank and said secondary plank extend in a spaced-apart and substantially perpendicular manner in substantially identical directions, providing intermittently spaced deflection resistance to the planks.

* * * * *